United States Patent [19]

van Os

[11] 4,004,358

[45] Jan. 25, 1977

[54] METHOD AND APPARATUS FOR DREDGING OF GROUND, PARTICULARLY SAND

[75] Inventor: Adriaan Gabriél van Os, Voorschoten, Netherlands

[73] Assignee: Stichting Speurwerk Baggertechniek, Delft, Netherlands

[22] Filed: Dec. 18, 1974

[21] Appl. No.: 533,953

[30] Foreign Application Priority Data

June 4, 1973 Netherlands ..... 7307773

[52] U.S. Cl. ..... 37/63; 37/195

[51] Int. Cl.² ..... E02F 3/92

[58] Field of Search ..... 37/58, 61, 62, 63, 64, 37/65, 66, 67, 78, 195; 299/81; 175/67; 61/72.4

[56] References Cited

UNITED STATES PATENTS

| | | | |
|---|---|---|---|
| 366,468 | 7/1887 | Edwards et al. | 37/63 |
| 396,112 | 1/1889 | Rice | 37/63 |
| 692,815 | 2/1902 | Bates | 37/63 |
| 723,122 | 3/1903 | Andersen | 37/78 X |
| 2,879,649 | 3/1959 | Elliott | 37/78 X |
| 3,402,487 | 9/1968 | Vaughan et al. | 37/78 |
| 3,540,194 | 11/1970 | Chaplin | 37/78 X |
| 3,688,511 | 9/1972 | Harmstrof | 37/62 X |

*Primary Examiner*—Clifford D. Crowder

*Attorney, Agent, or Firm*—Flynn & Frishauf

[57] ABSTRACT

Soil, particularly water saturated sand, is loosened by means of at least one cutting blade and thereafter is sucked up. An auxiliary fluid is supplied at the position of the slip failure plane due to movement of each moving cutting blade in the soil.

7 Claims, 5 Drawing Figures

METHOD AND APPARATUS FOR DREDGING OF GROUND, PARTICULARLY SAND

The invention relates to a method for dredging to loosen waterlogged, or saturated soil, particularly submerged sand, by means of at least one cutting blade so that it can thereafter be removed by suction.

When suction dredging, particularly trailing suction dredging, is used, a cutting blade is mounted on a suction mouth piece and pulled during the movement of the dredge vessel through the soil, or sand layer to loosen the soil, or sand. The soil, or sand, loosened by the cutting blade is then sucked up, mixed with water.

It has also been proposed to loosen the soil by a rotary cutter head, located adjacent the mouth of a suction pipe to loosen the sand, or soil from the underlying ground layer, which is not to be disturbed.

It has been proposed (see Dutch published patent application 65 01314), to use water jets to further loosen the soil to be sucked up from the underlying layer. This known method is directed to injecting water into the ground in front of a moving suction mouth to thereby break the grain tension of the ground slice in the area in front of the suction mouth, so that the ground is fluidized. However, this does not include a cutting blade moving through the ground.

When the cutting blades are moved through the soil, slip failure planes are produced. A slice of ground situated directly in front of each cutting blade of the cutting means is loosened by shear with respect to the undisturbed soil layer mass; the shear forces produce relative movement along well defined planes, referred to as slip, or failure planes.

Extensive experiments have shown that, at least in the range of cutting velocities which can be usefully employed, there is produced at the position of the failure plane, or planes respectively, a zone which is characterized by a strongly decreased water pressure and a correspondingly increased effective normal stress. This increased effective stress, caused by the phenomenon of "dilatancy" results in increased resistance to shear along the failure planes.

The phenomenon of dilatancy is well known in hydraulic engineering and has been described in the literature. Briefly, Dilatancy is the appearance of volumetric changes in the soil skeleton due to shear. When densely packed soil is sheared, the particles have to climb over one another. The porosity of the skeleton will increase by this action. When the shearing is performed under water with the sand saturated, the increase in volume will produce a decrease of pore pressure (water pressure) with respect to the hydrostatic pressure. These negative excess pore pressures will in turn increase the normal stresses between the grains. In other words, the grains are pushed together by the negative excess pore pressure (water pressure). For more detailed explanations, the reader is referred to:

— I. K. Lee (ed.): "Soil Mechanics, Selected Topics", Butterworths, London (1968). Chapter 4.3 , pp. 222 – 233.

— P. W. Rowe (1962): "The stress dilatancy relation for static equilibrium of an assembly of particles in contact", Proc. Royal Soc. of London 269. Series A, pp. 500 – 527.

It is an object of the invention to remove the undesirable results due to the generation of dilatancy zones.

Subject matter of the Invention: Briefly, fluid, e.g. water or air, is introduced at the location of the slip failure plane produced by moving the cutting blade in the submerged layer of soil, or sand.

The effect of the auxiliary fluid is that the decrease in local water pressure, which otherwise might decrease to the value of the vapour pressure in water prevailing at the spot, is itself decreased, so that the effective stress to be overcome is reduced. Compared with the previously known dredging methods, the force required is reduced when practicing the present invention.

The invention also relates to an apparatus for performing the method; the apparatus uses at least one cutting blade, and, in accordance with the invention, means are provided adjacent said cutting blade for supplying the auxiliary fluid, which are mounted with respect to the cutting blade such that the flow apertures or nozzles thereof are situated at the position of the slip or failure planes which arise in the soil due to the cutting movement of the cutting blades.

The invention will be described by way of example with reference to the accompanying drawings.

Figure 3:
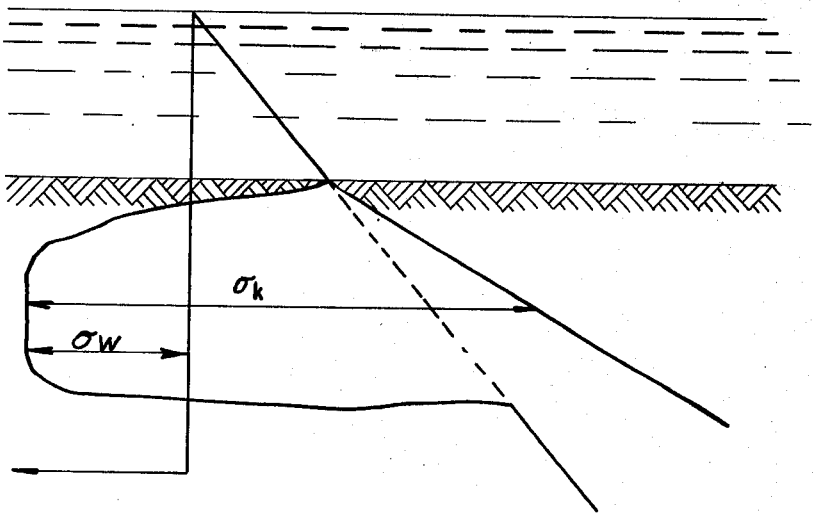
FIG. 3 is a diagram similar to FIG. 2, showing dynamic the distribution of stress and pressures when a cutter blade is moving, the cutting of the ground causing dilatancy.
Figure 4:
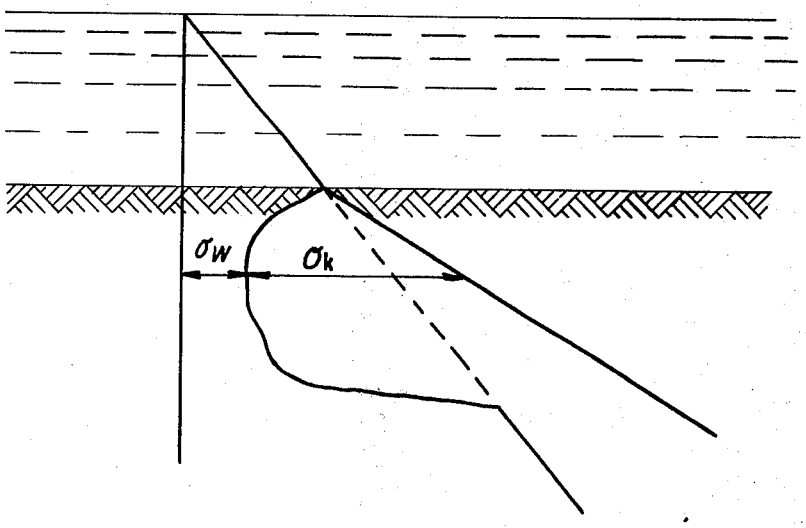
Figure 5:
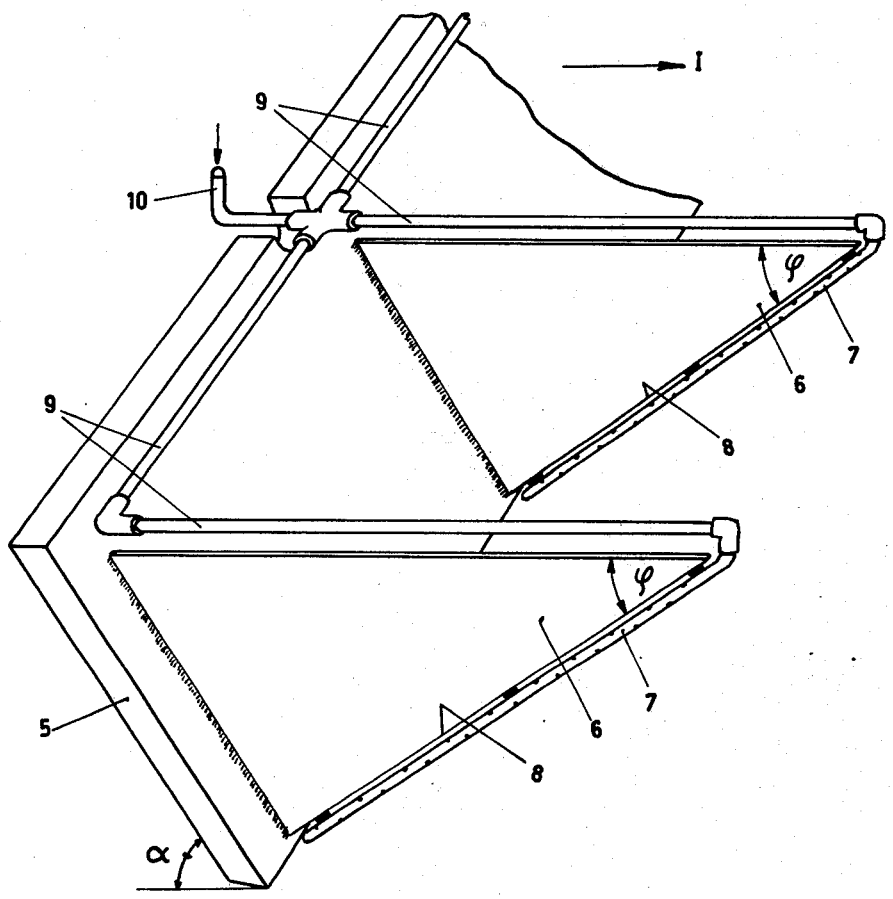

FIG. 4 is a diagram similar to FIG. 3 showing the dynamic distribution of stress and pressures in water and in the submerged soil therebeneath, in which the influence of the occurring dilatancy, as shown in the diagram of FIG. 3, has been reduced in accordance with the invention by the supply of an auxiliary fluid; and FIG. 5 is a schematic perspective view of the lower part of an apparatus according to the invention to be used as a trailing dredge.

Before discussing the theory, the dredge apparatus will be explained.

FIG. 5 shows part of a single cutting blade 5 adapted to be mounted in known manner to the mouth of a suction tube (not shown) as part of a so-called trailing suction dredge. It is pulled in direction of arrow I. The cutting blade 5 is placed during operation under the cutting angle $\alpha$. According to the invention, injection nozzles shaped as perforated tubes 7 are provided along the obliquely rising edges 8 of webs 6, located in front of the blade 5 and extending in the cutting direction I. The inclination angle of the edges 8 and thereby that of the injection tubes 7 has been chosen corresponding to the angle $\phi$ (see FIG. 1) which is the angle of the failure slip plane (explained below) which will be formed during the cutting operation. The injection tubes 7 are connected through connecting conduits 9 with a common supply conduit 10 for the auxiliary fluid, usually air or water.

Figure 1:
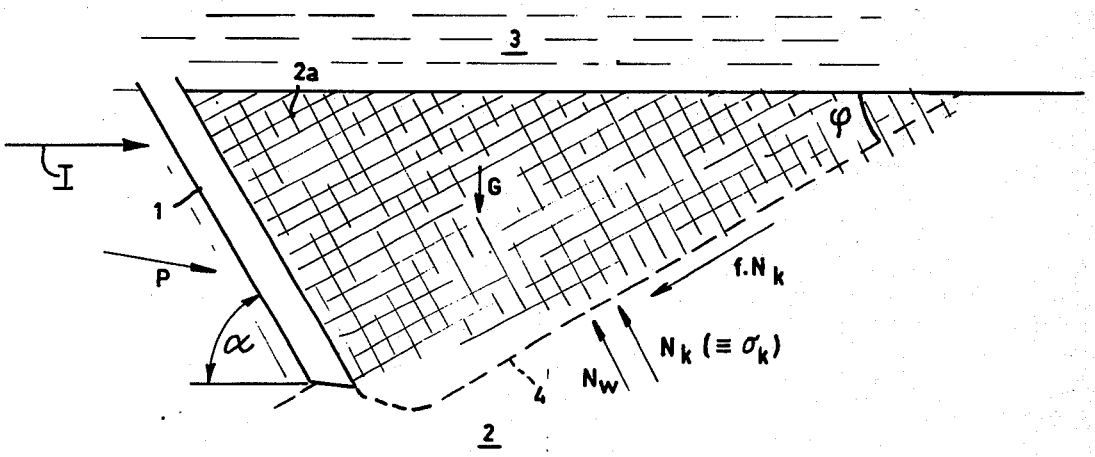
FIG. 1 shows a schematic section in which the forces occurring when cutting submerged soil, or sand are indicated.

The method, and basis for the invention will now be described, with reference to FIG. 1. A cutting blade 1 (shown schematically) is about to move in the direction of arrow I, eg. by being pulled. It is located beneath a soil, or sand, layer 2, under a body of water 3. The ground slice 2*a* in front of the blade 1 thereby tends to shear off; the direction of shear will occur along a well defined zone, namely the slip or failure plane 4. This plane 4 extends from a point in the vicinity of the cutting edge of the cutting blade 1 under an angle $\phi$. The angle will depend on the composition and type of soil, or sand. At any instant the force P to be imparted to the cutting blade 1 will balance the weight G of the soil, or sand slice $2a$, the normal forces $N_K$ and $N_w$ imparted by the still untouched ground layer and by the water therein and the friction force $fN_K$ acting along the slip plane 4 ($f$ indicating the coefficient of friction).

Figure 2:
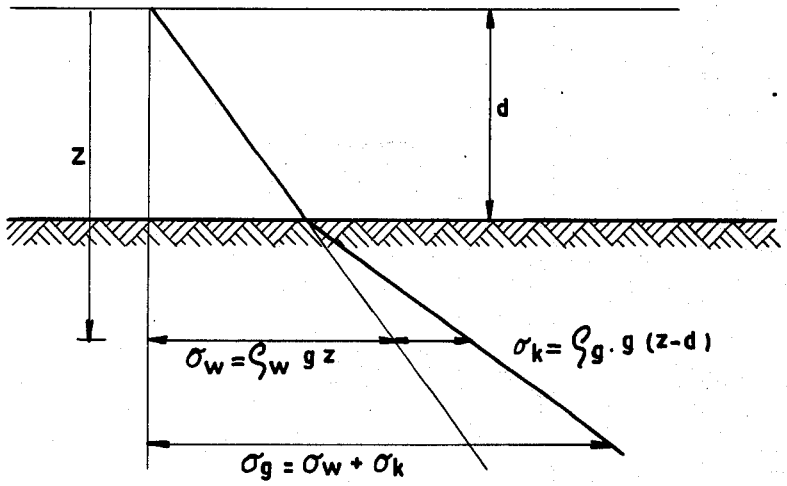
FIG. 2 shows a diagram in which the static distribution of stress and vertical pressures in water and in the submerged soil therebeneath are indicated.

As appears from the diagram according to FIG. 2, the total stress or the soil stress $\sigma_g$ at a depth $z$ comprises the sum of the water pressure $\sigma_w$ and the effective or grain stress $\sigma_K$. The diagram according to FIG. 3 shows the distribution of pressures in the dilatancy zone which is generated during the cutting operation (at the position of the slip, or failure plane). In the dilatancy zone, the water pressure $\sigma_w$ appears as underpressure with the result that the total, effective stress $\sigma_k$ has increased correspondingly. Thus the soil in the dilatancy zone is prestressed, or over stressed, and, as a result thereof, is more difficult to cut.

The diagram according to FIG. 4 shows the effect when proceeding in accordance with the invention. A major portion of the water under pressure (as shown in the diagram according to FIG. 3) has been cancelled by supplying, according to the invention, an auxiliary fluid such as air or water into the dilatancy zone along the failure, or slip plane. The effective, or grain stress $\sigma_k$ has been substantially decreased. Thus, the ground is sheared more easily so that the required cutting power is substantially decreased.

The apparatus of the invention is, of course, not restricted to the type of cutter as shown in FIG. 5. The supply of an auxiliary fluid may be arranged in a manner similar also to suction dredge apparatus having other types of cutters.

I claim:

1. A method of underwater dredging in which soil or sand is loosened comprising moving at least one cutting blade (1, 5) through the soil;

providing means at the failure slip plane arising upon movement of the cutting blade to supply an auxiliary fluid; and supplying the auxiliary fluid in advance of the cutting blade, at the position of the failure slip plane in the soil, or sand, arising upon movement of the cutting blade (1, 5).

2. A method according to claim 1, wherein the auxiliary fluid is air.

3. A method according to claim 1, wherein the auxiliary fluid is water.

4. Underwater dredging apparatus to dredge soil or sand comprising a cutting blade (5) and means (7, 8, 9, 10) including fluid nozzles (7) for supplying an auxiliary fluid, in advance of the blade (5)

wherein said nozzles (7) of the auxiliary fluid supply means are positioned with respect to said cutting blade (5) to be located at the position of the failure slip plane of the soil, or sand produced by each cutting blade during the movement thereof through the soil, or sand during dredging.

5. Apparatus according to claim 4 further comprising projecting support means (6) projecting in advance of the blade (5), —with respect to dredging movement thereof — the auxiliary fluid supply means being secured to said support means.

6. Apparatus according to claim 5, wherein the support means comprises projecting webs having an upwardly inclined lower edge, the angle of inclination — with respect to water level — of said edge being similar to the angle of the failure slip plane.

7. Apparatus according to claim 6, wherein the nozzles (7) are located adjacent the lower edge (8) of the web.

* * * * *